US010978791B2

(12) United States Patent
Gommé et al.

(10) Patent No.: US 10,978,791 B2
(45) Date of Patent: Apr. 13, 2021

(54) COMBINATION ANTENNA

(71) Applicant: NXP B.V., Eindhoven (NL)

(72) Inventors: Liesbeth Gommé, Anderlecht (BE); Anthony Kerselaers, Herselt (BE)

(73) Assignee: NXP B.V., Eindhoven (NL)

( * ) Notice: Subject to any disclaimer, the term of this patent is extended or adjusted under 35 U.S.C. 154(b) by 128 days.

(21) Appl. No.: 15/972,614

(22) Filed: May 7, 2018

(65) Prior Publication Data

US 2019/0341678 A1 Nov. 7, 2019

(51) Int. Cl.

| | |
|---|---|
| ***H01Q 1/27*** | (2006.01) |
| ***H01Q 7/00*** | (2006.01) |
| ***H01Q 9/16*** | (2006.01) |

(52) U.S. Cl.

CPC ..... *H01Q 1/273* (2013.01); *H01Q 7/00* (2013.01); *H01Q 9/16* (2013.01)

(58) Field of Classification Search

CPC ..... H01Q 1/242; H01Q 1/243; H01Q 1/244

See application file for complete search history.

(56) References Cited

U.S. PATENT DOCUMENTS

| | | | | |
|---|---|---|---|---|
| 7,843,347 | B2 | 11/2010 | Nikitin et al. | |
| 8,902,119 | B2 | 12/2014 | Menke et al. | |
| 9,197,986 | B1 | 11/2015 | Kerselaers | |
| 9,236,656 | B2 | 1/2016 | Kerselaers et al. | |
| 9,577,348 | B2 | 2/2017 | Gommé et al. | |
| 2009/0153303 | A1 | 6/2009 | Forster | |
| 2012/0231732 | A1 | 9/2012 | Kerselaers | |
| 2013/0257676 | A1 | 10/2013 | Kerselaers | |
| 2015/0319545 | A1 | 11/2015 | Kerselaers | |
| 2016/0344109 | A1* | 11/2016 | Gomme | H01Q 7/00 |
| 2017/0062949 | A1* | 3/2017 | Kerselaers | H04B 5/0031 |

FOREIGN PATENT DOCUMENTS

| | | | |
|---|---|---|---|
| EP | 2026406 | A1 | 2/2009 |

* cited by examiner

*Primary Examiner* — Binh B Tran

(57) ABSTRACT

One example discloses a combination antenna, including a near-field antenna, having a first portion and a second portion; and a far-field antenna, having a cavity; wherein the first portion of the near-field antenna structure is inside the cavity and the second portion is outside of the cavity.

18 Claims, 5 Drawing Sheets

COMBINATION ANTENNA

The present specification relates to systems, methods, apparatuses, devices, articles of manufacture and instructions for near-field and far-field electromagnetic radiation.

SUMMARY

According to an example embodiment, a combination antenna, comprising: a near-field antenna structure, having a first portion and a second portion; and a far-field antenna, having a cavity; wherein the first portion of the near-field antenna structure is inside the cavity and the second portion is outside of the cavity.

In another example embodiment, the second portion is a short-loaded dipole antenna.

In another example embodiment, the first portion is a small loop antenna.

In another example embodiment, the second portion of the near-field antenna structure includes a conductive plate; and the conductive plate is configured to communicate E-field signals.

In another example embodiment, the first portion of the near-field antenna structure includes a first portion (e.g. L1) of a coil configured to communicate H-field signals; and the second portion of the near-field antenna includes a second portion (e.g. L2) of the coil configured to communicate H-field signals.

In another example embodiment, the far-field antenna includes a set of vias coupling the inside of the cavity to the outside of the cavity; and the first and second portions of the near-field antenna are coupled through the vias.

In another example embodiment, the vias include at least one of: a hole, a conductive contact, or a connecting wire.

In another example embodiment, the vias are located on a dielectric portion of the far-field antenna.

In another example embodiment, the near-field antenna includes a first set of feeding connections; the far-field antenna includes a second set of feeding connections; and the first and second set of feeding connections are not directly galvanically coupled.

In another example embodiment, further comprising a dielectric coupled between the cavity and the first portion of the near-field antenna structure is inside the cavity.

In another example embodiment, the dielectric is at least one of: ferrite, air, foam or a solid insulator.

In another example embodiment, the far-field antenna includes a body structure; the far-field antenna includes a first conductive plate coupled to one end of the body structure and to a first feeding connection; and the far-field antenna also includes a second conductive plate coupled to an opposite end of the body structure and to a second feeding connection.

In another example embodiment, the far-field antenna includes a set of feeding connections; and the set of feeding connections are positioned closer to the first conductive plate than the second conductive plate.

In another example embodiment, the far-field antenna includes a set of feeding connections; and the set of feeding connections are positioned equidistant from the first and second conductive plates.

In another example embodiment, further comprising a dielectric coupled between the set of conductive plates, of the far-field antenna, and the first portion of the near-field antenna structure is inside the cavity.

In another example embodiment, further comprising an inductive element coupled between one of the conductive plates and the first feeding connection; and wherein the inductive element is formed on an outside surface of the body structure.

In another example embodiment, the inductive element is wound completely around the body structure.

In another example embodiment, the body structure is at least one of: a hollow cylindrical tube, a lattice structure, or a container.

In another example embodiment, the body structure is either formed from a dielectric material or coated with the dielectric material.

According to an example embodiment, a portable electronic device, comprising: a combination antenna; wherein the combination antenna includes, a near-field antenna structure, having a first portion and a second portion; and a far-field antenna, having a cavity; wherein the first portion of the near-field antenna structure is inside the cavity and the second portion is outside of the cavity; and wherein the portable electronic device is at least one of: a hearing aid, a hearable, a medical device, a communication device, or a sensing device.

The above discussion is not intended to represent every example embodiment or every implementation within the scope of the current or future Claim sets. The Figures and Detailed Description that follow also exemplify various example embodiments.

Various example embodiments may be more completely understood in consideration of the following Detailed Description in connection with the accompanying Drawings, in which:

Figure 1:
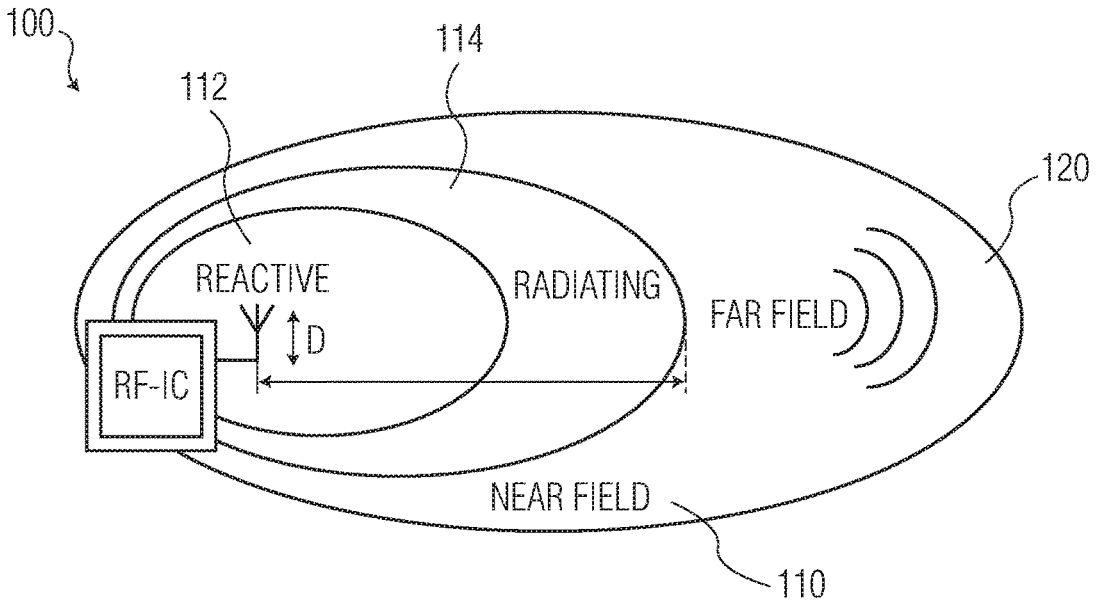
FIG. 1 is an example set of electromagnetic regions.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

DETAILED DESCRIPTION

Wireless communications may exist in near-field regions and far-field regions. In a far-field region, information is carried by electromagnetic (EM) wave radiation. In a near-field region, information is carried by electromagnetic H-field and/or E-field induction.

While far-fields refer to a region around a radiating antenna in which electromagnetic waves are radiated into space, near-fields describe a region close to a transmitting antenna in which non-radiating magnetic waves exist.

A boundary between the near-field and far-field region may not be fixed and the boundary may change with operating frequency. The boundary between a near-field and far-field region may be defined using transmission range, wave impedance or phase variation of radiation.

Far-fields are most useful when communicating between larger distances (e.g. greater than 1 meter between smartphones, vehicles, structures, and/or distant radio towers).

Near-fields are most useful when communicating between nodes of a body-network (e.g. less than 1 meter between a smartphone, ear-buds, hearing-aids, medical monitoring devices, smart-fabrics, and/or other devices attached to a body).

FIG. 1 is an example set of electromagnetic wave regions 100. Electromagnetic waves include electric (E) fields and magnetic (H) fields. Two main regions 100, having a radio frequency integrated circuit (RF-IC) at their focal points, include a near-field region 110 and a far-field region 120.

In the far-field region 120, a combination of E-field and H-field waves propagate perpendicular to each other and to the direction of propagation.

The near-field region 110 includes two sub-regions, a reactive induction region 112 and a radiating propagation region 114. In the radiating region 114, an angular field distribution depends on distance, while in the reactive zone 112, energy is stored and not radiated. A precise boundary between these two regions 112, 114 is based on a specific application (e.g. antenna structure, frequency, etc.). Communication in the near-field region 110 can occur through the E-field and/or the H-field.

Example embodiments of the combination antenna described herein are applicable to near-field communication using either or both the E and H induction fields.

Figure 2:
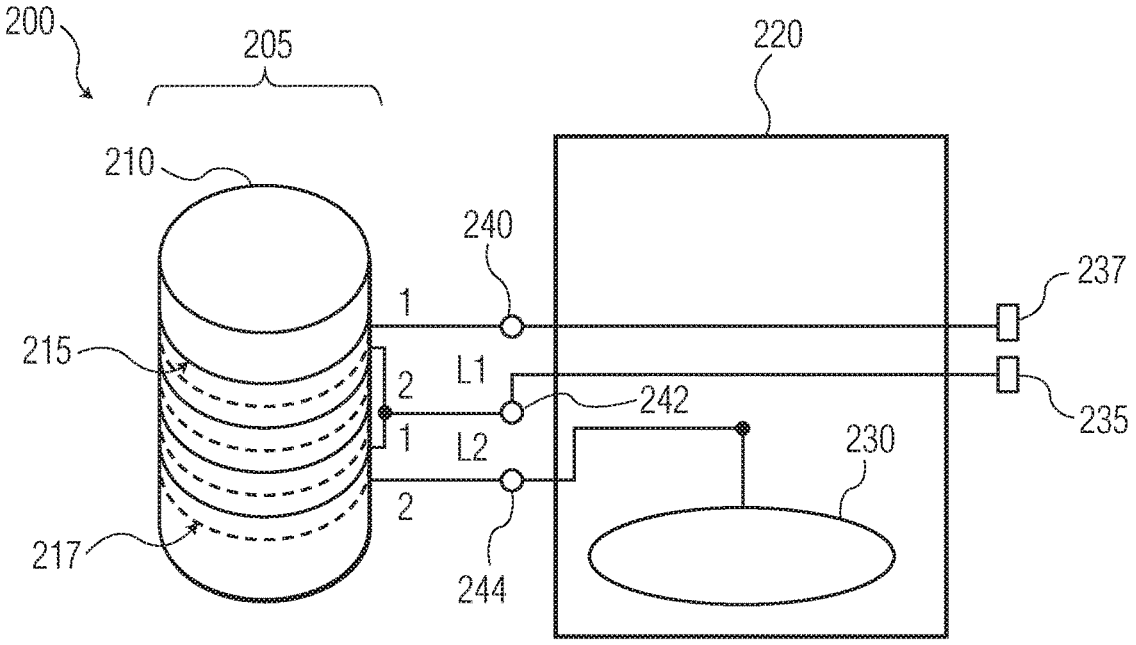
FIG. 2 is an example near-field electric magnetic induction (NFEMI) antenna.

FIG. 2 is an example near-field antenna structure 200, that in some example embodiments is used in hearing aids or hearables. The near-field antenna structure 200 in various example embodiments may be a near-field electric magnetic induction (NFEMI) antenna and/or a near-field magnetic induction (NFMI) antenna. The discussion that follows presents the NFEMI antenna version of the near-field antenna structure 200.

In an NFEMI embodiment, the near-field antenna structure 200 includes a small loop antenna 205 (responsive to the H-field) and a short-loaded dipole 220 (responsive to the E-field).

The small loop antenna 205 includes a ferrite core 210, a first coil 215 (having an inductance L1) and a second coil 217 (having an inductance L2). The short-loaded dipole 220 includes at least one conductive plate 230. A first near-field feeding connection 237 and a second near-field feeding connection 235 is coupled to additional receiver, transmitter, baseband, and other communication processing circuitry (not shown). For later discussion purposes, connection points 240, 242, and 244 are also shown.

Both coils 215, 217 may be connected such that they form a larger inductance compared with the inductance of the first coil 215 and the second coil 217. Either one or both coils 215, 217 may be coils, wrapped as copper windings around a cylindrical dielectric 210 (e.g. air, ferrite, etc.), or the coils 215, 217 can be formed on a planar surface structure. In some example embodiments the coils 215, 217 are wrapped around the core 210 in an interleaved fashion. In other example embodiments the coils 215 and 217 are wrapped on top of one another, i.e., the second coil 217 is first wrapped around the core 210, and then the first coil 215 is then wrapped around the core 210 on top of the second coil 217.

Connection point 240 at one end of the first coil 215 is coupled to the first near-field feeding connection 237. Connection point 244 at one end of the second coil 217 is connected to the conductive plate 230 of the small loaded dipole 220. Connection point 242 is coupled to the other ends of the coils 215, 217 and to the second near-field feeding connection 235.

Now discussed are some embodiments of a combination near-field and far-field communication antenna that can transmit and/or receive both far-field EM radiation and near-field EM induction signals. The combination antenna permits a device's form-factor to be reduced (e.g. 20-25 mm total diameter) so that it can be integrated into very small devices, such as portable products attached to the human body.

Figure 3:
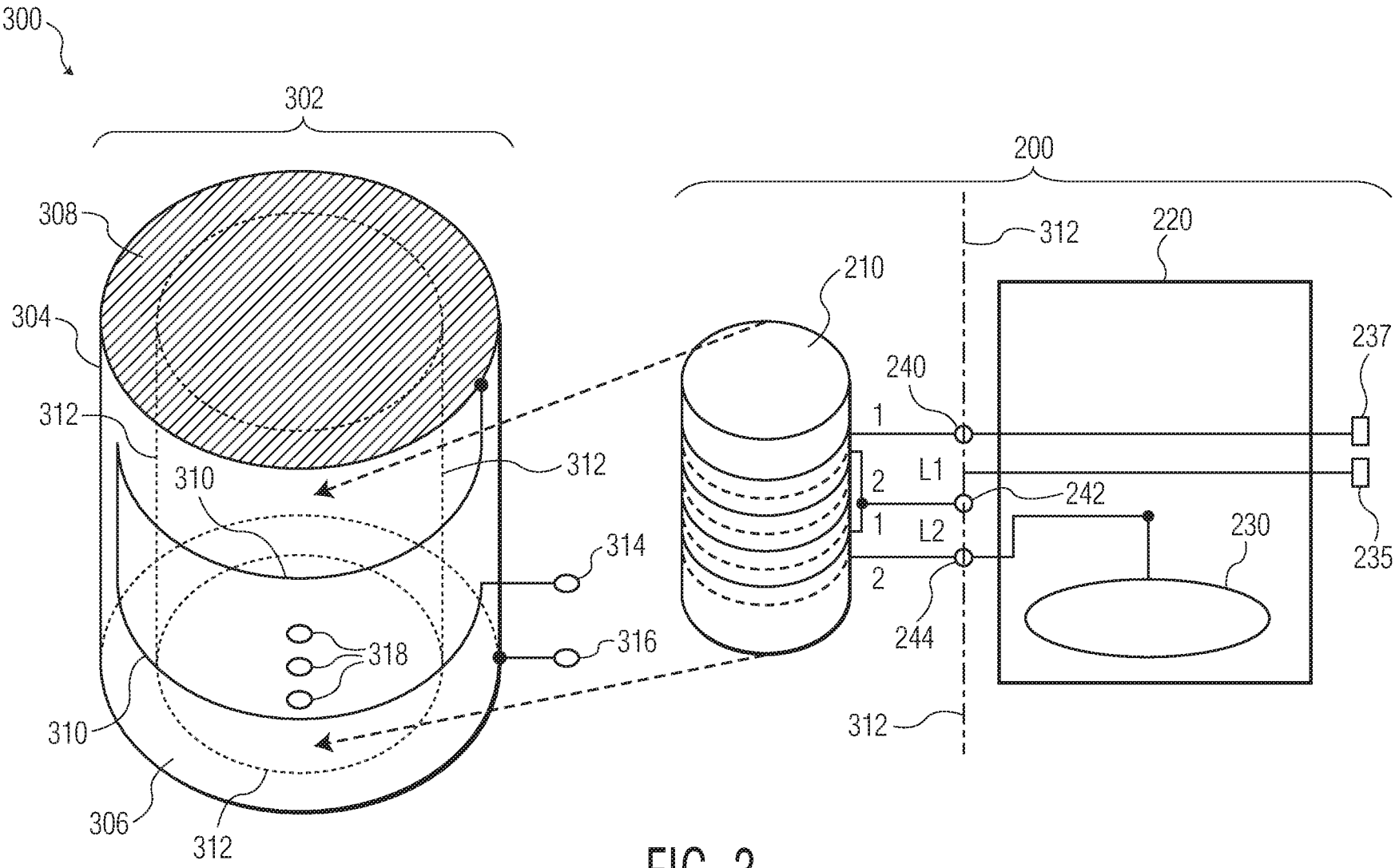
FIG. 3 is an example combination antenna prior to assembly.

FIG. 3 is an example combination antenna 300 prior to assembly. The combination antenna 300 includes the near-field antenna structure 200 and a far-field antenna structure 302. The near-field antenna structure 200 includes the elements discussed in FIG. 2.

The near-field antenna 200, has a first portion and a second portion and the first portion of the near-field antenna 200 structure is inside the cavity 312 of the far-field antenna 302 and the second portion is outside of the cavity 312 of the far-field antenna 302.

In some example embodiments, the first portion is a small loop antenna (e.g. the H-field antenna 205) and the second portion is a short-loaded dipole antenna (e.g. the E-field antenna 220).

The far-field antenna 302 includes a body structure 304, a first conductive plate 306, a second conductive plate 308, an inductive element 310 (e.g. wire or filament), a cavity 312, a first far-field feeding connection 314, a second far-field feeding connection 316, and a set of vias 318.

The body structure 304 can be: a hollow cylindrical tube, a lattice structure, or a container. The body structure 304 can also be either formed from a dielectric material or coated with the dielectric material.

The far-field antenna's 302 first conductive plate 306 is coupled to one end of the body structure 304 and to the first feeding connection 316. The far-field antenna's 302 second conductive plate 308 is coupled to an opposite end of the body structure 304 and to the second feeding connection 314.

In some example embodiments, the set of feeding connections 314, 316 are positioned closer to (i.e. unbalanced) the first conductive plate 306 than the second conductive plate 308. This allows current flow to be different through one plate or the other.

In other example embodiments, the set of feeding connections 314, 316 are positioned equidistant from the first and second conductive plates 306, 308 so as to allow far-field current flow to be uniform through the far-field antenna 302.

Some example embodiments, also include an inductive element coupled between one of the conductive plates 306 or 308 and the first feeding connection 314. The inductive element can be formed on an outside surface of the body structure 304, and may even be wound completely around the body structure 304.

When an RF alternating current passes through the inductive element 310 a distributed inductance together with the capacitance formed by the two antenna elements 306, 308 and the insulating/dielectric/ferrite body structure 304, resonate at a frequency band of operation.

In various example embodiments, there is a dielectric coupled between the cavity 312, and its conductive plates 306, 308, and the first portion of the near-field antenna 200. The dielectric can be: ferrite, air, foam or a solid insulator.

The first portion of the near-field antenna 200 includes a first portion (e.g. the first coil 215 (L1)) and the second portion (e.g. the second coil 217 (L2)) both configured to communicate H-field signals. The second portion of the near-field antenna 200 includes the conductive plate 230 which is configured to communicate E-field signals.

Figure 4:
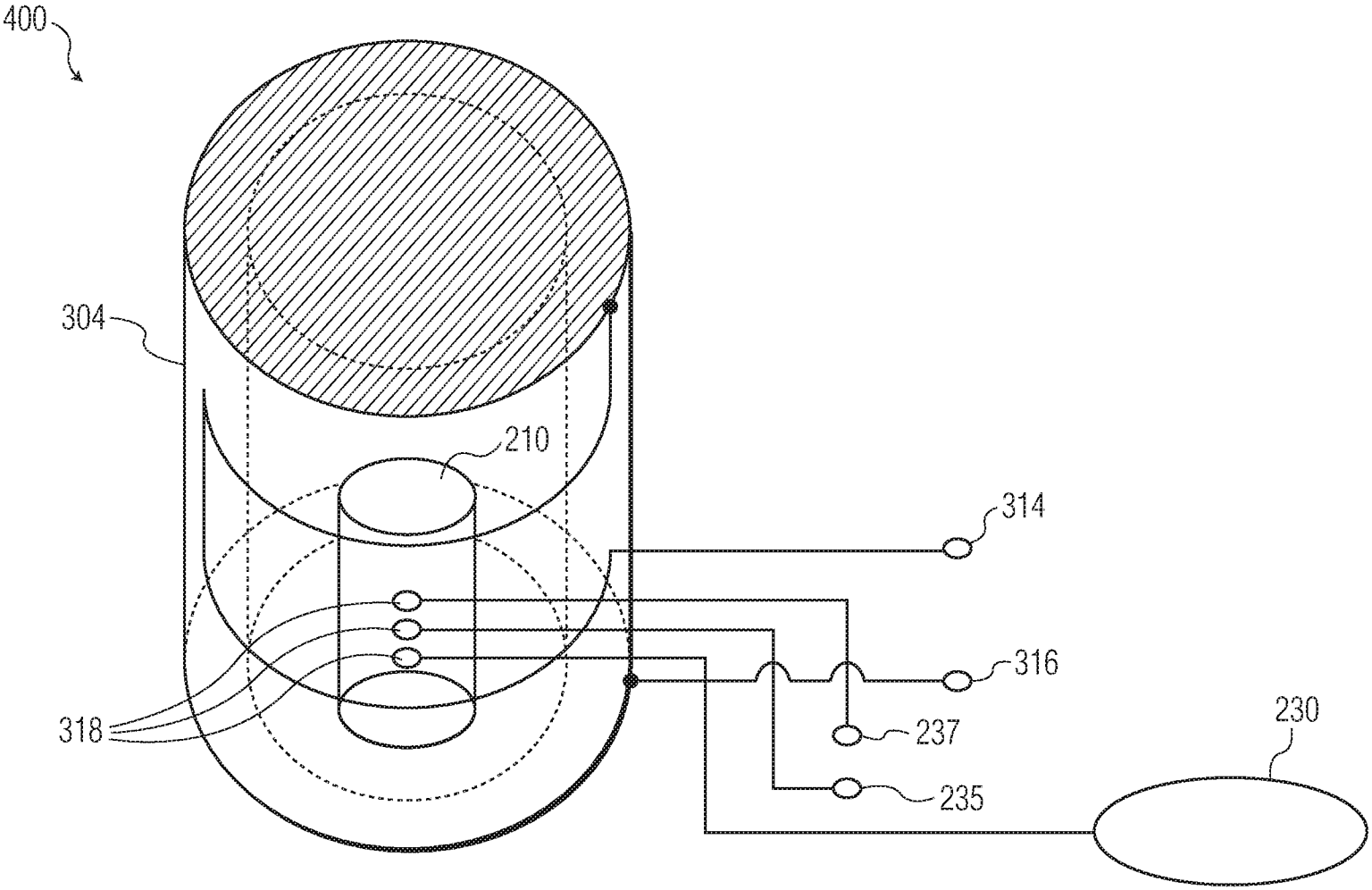
FIG. 4 is an example of the combination antenna after assembly.

In the example embodiment shown in FIG. 4, all elements of the combination antenna 300, except the conductive plate 230, are inside the cavity 312. The conductive plate 230 is outside of the cavity 312.

When portions of the antenna 200 are inside the cavity 312 of the body structure 304, connection points 240, 242, 244 pass through the body structure 304 through the set of vias 318. The set of vias 318 couple the inside of the cavity 312 to the outside of the cavity 312 and the first and second portions of the near-field antenna 200 are coupled through the vias 318. The vias 318 in various example embodiments can be: a hole, a conductive contact, or a connecting wire.

FIG. 3 also shows the vias 318 located on a dielectric portion of the far-field antenna 302. The set of vias 318 can be located either together or separately at various locations in the body structure 304, depending upon the combination antenna's 300 application.

The first 237, 235 and second 314, 316 sets of feeding connections are not directly galvanically coupled in many example embodiments. Instead, the near-field feeding connections 237, 235 and far-field feeding connection 314, 316 in various example embodiments are separately and respectively connected to various other near-field and far-field baseband and/or signal processing circuits (not shown) to send and receive near-field and far-field signals (e.g. audio, data, etc.) through the near-field antenna 200 and the far-field antenna 302 in the combination antenna 300.

The combination antenna 300 itself can also be embedded in a portable electronic device such as: a hearing aid, a hearable, a medical device, a communication device, or a sensing device.

FIG. 4 is an example 400 of the combination antenna 300 after assembly. The example shows the H-field antenna 205 (small loop) with the ferrite core 210 inside of the cavity 312 and the E-field antenna 220 (short-loaded dipole) with the conductive plate 230 outside of the cavity 312.

When the combination antenna 300 is placed on a body or a structure, the conductive plate 230 is positioned as close as possible to the body or the structure so as to maximize a link-budget for receiving and/or transmitting near-field signals.

Figure 5:
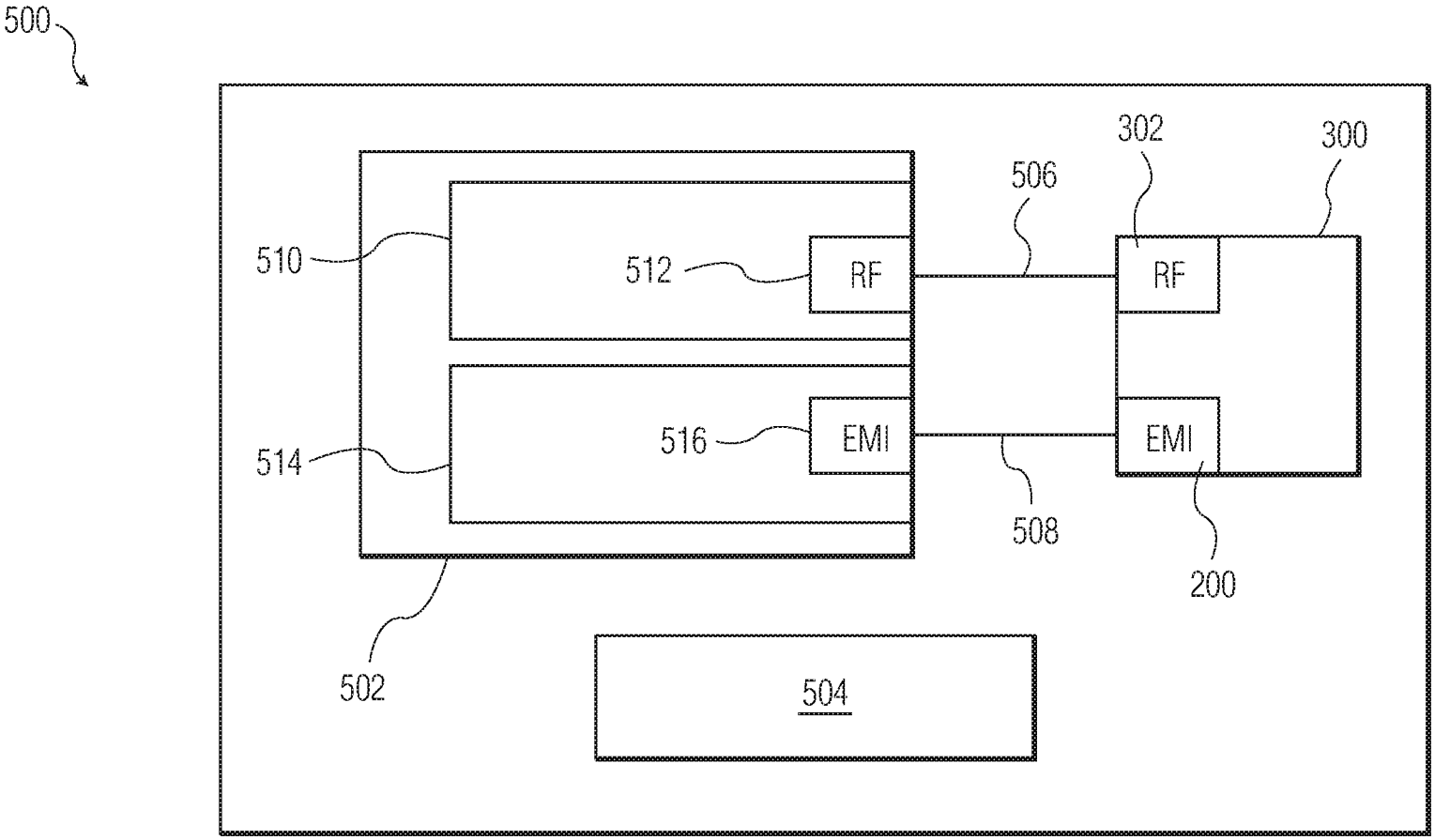
FIG. 5 is an example electronic device including the combination antenna coupled to a radio integrated circuit (IC).

FIG. 5 is an example electronic device 500 including the combination antenna 300. The electronic device 500 (e.g. a hearing aid or ear bud) includes the combination antenna 300, a set of baseband/signal processing electronics 502, and a loud-speaker/microphone unit 504.

The combination antenna 300 is coupled to baseband/signal processing electronics 502 through connections 506 and 508 (e.g. wires). The combination antenna 300 includes the near-field antenna structure 200 and the far-field antenna structure 302 discussed above.

The baseband/signal processing electronics 502 includes far-field radio communications circuits 510, having an input/output interface 512, and near-field radio communications circuits 514, having an input/output interface 516.

The baseband/signal processing electronics 502 transmits and receives and audio and data received from the combination antenna 300.

Figure 6A:
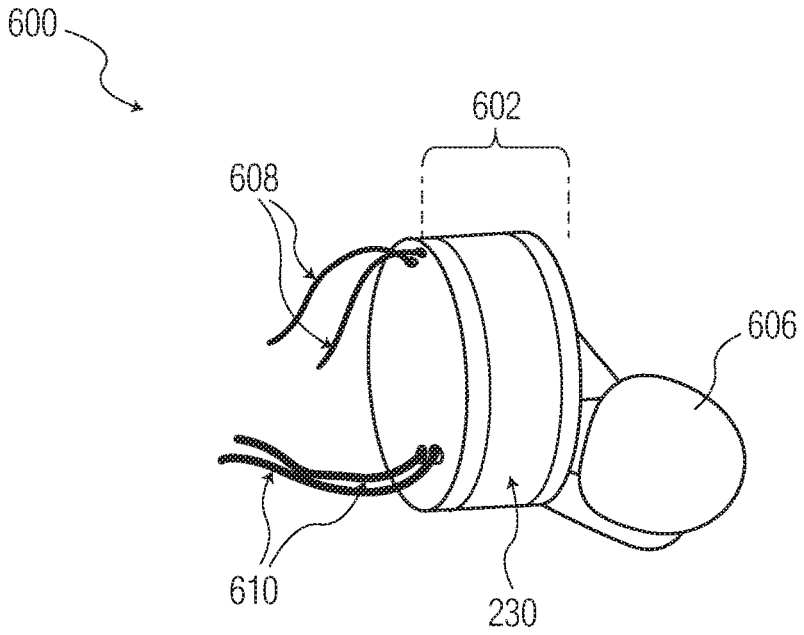
FIGS. 6A and 6B are two different views of an example practical implementation of the combination antenna after assembly.
Figure 6B:
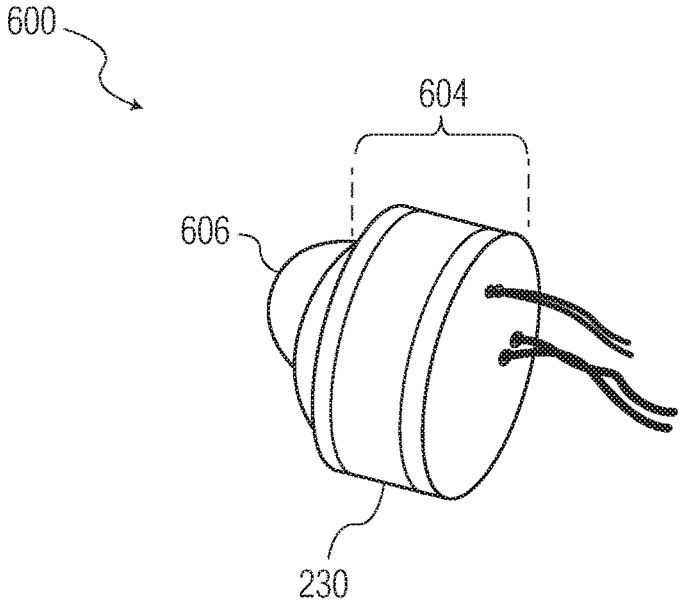

FIGS. 6A and 6B are examples 600 of two different views 602, 604 of an example practical earbud implementation of the combination antenna 300 after assembly.

In this example embodiment, all elements of the combination antenna 300, except the conductive plate 230, are inside the earbud casing (e.g. a plastic casing). Due to the casing's compact form-factor, it can be placed inside a user's external ear area.

The conductive plate 230 (e.g. a conductive strip) in this example embodiment wraps around outside of the far-field antenna structure 302 in the casing. A deformable portion 606 of the earbud can be placed inside a user's outer ear canal area.

Also shown are a first set of wires 608 and a second set of wires 610. The first set of wires 608 is for connecting to the near-field radio communication circuit. The second set of wires 610 is for connecting to the loudspeaker.

The combination antennas described herein can be integrated into various fixed or portable devices attached or adjacent to a user or various other structures. For example devices having combination antennas may include hearing aids, ear buds, headphones, and various other commercial, consumer lifestyle and/or healthcare devices.

In some example embodiments antenna diversity and signal robustness may be achieved using multiple devices each having their own combination antenna (e.g. two earbuds, a smartphone and one earbud, etc.). Thus as environmental conditions change such devices can at one time communicate using far-field and at another time communicate using near-field.

It will be readily understood that the components of the embodiments as generally described herein and illustrated in the appended figures could be arranged and designed in a wide variety of different configurations. Thus, the detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

What is claimed is:

1. A combination antenna, comprising:

a near-field antenna structure, having a first portion and a second portion; and a far-field antenna, having a cavity;

wherein the first portion of the near-field antenna structure is inside the cavity and the second portion is outside of the cavity, wherein the far-field antenna includes a set of conductive contact vias coupling the inside of the cavity to the outside of the cavity, wherein the first portion is a small loop antenna;

wherein the second portion includes a conductive plate; and wherein the conductive plate is configured to communicate E-field signals.

2. The antenna of claim 1, wherein the second portion is a short-loaded dipole antenna.

3. The antenna of claim 1, wherein the first portion of the near-field antenna structure includes a first portion of a coil configured to communicate H-field signals; and wherein the second portion of the near-field antenna includes a second portion of the coil configured to communicate H-field signals.

4. The antenna of claim 1, wherein the first and second portions of the near-field antenna are coupled through the vias.

5. The antenna of claim 4, wherein the vias are located on a dielectric portion of the far-field antenna.

6. The antenna of claim 1, wherein the near-field antenna includes a first set of feeding connections;

wherein the far-field antenna includes a second set of feeding connections; and wherein the first and second set of feeding connections are not directly galvanically coupled.

7. The antenna of claim 1, further comprising:

a dielectric coupled between the cavity and the first portion of the near-field antenna structure is inside the cavity.

8. The antenna of claim 7, wherein the dielectric is at least one of: ferrite, air, foam or a solid insulator.

9. The antenna of claim 1, wherein the far-field antenna includes a body structure;

wherein the far-field antenna includes a first conductive plate coupled to one end of the body structure and to a first feeding connection; and wherein the far-field antenna also includes a second conductive plate coupled to an opposite end of the body structure and to a second feeding connection.

10. The antenna of claim 9, wherein the far-field antenna includes a set of feeding connections; and wherein the set of feeding connections are positioned closer to the first conductive plate than the second conductive plate.

11. The antenna of claim 9, wherein the far-field antenna includes a set of feeding connections; and wherein the set of feeding connections are positioned equidistant from the first and second conductive plates.

12. The antenna of claim 9, further comprising:

a dielectric coupled between the set of conductive plates, of the far-field antenna, wherein the first portion of the near-field antenna structure is inside the cavity.

13. The antenna of claim 9, further comprising:

an inductive element coupled between one of the conductive plates and the first feeding connection, wherein the inductive element is formed on an outside surface of the body structure.

14. The antenna of claim 13, wherein the inductive element is wound completely around the body structure.

15. The antenna of claim 9, wherein the body structure is at least one of: a hollow cylindrical tube, a lattice structure, or a container.

16. The antenna of claim 9, wherein the body structure is either formed from a dielectric material or coated with the dielectric material.

17. A portable electronic device, comprising:

a combination antenna; wherein the combination antenna includes, a near-field antenna structure, having a first portion and a second portion; and a far-field antenna, having a cavity, wherein the first portion of the near-field antenna structure is inside the cavity and the second portion is outside of the cavity wherein the far-field antenna includes a set of conductive contact vias coupling the inside of the cavity to the outside of the cavity, wherein the first portion is a small loop antenna, wherein the second portion includes a conductive plate, wherein the conductive plate is configured to communicate E-field signals, and wherein the portable electronic device is at least one of: a hearing aid, a hearable, a medical device, a communication device, or a sensing device.

18. A combination antenna, comprising:

a near-field antenna structure, having a first portion and a second portion; and a far-field antenna, having a cavity, wherein the first portion of the near-field antenna structure is inside the cavity and the second portion is outside of the cavity, wherein the far-field antenna includes a set of conductive contact vias coupling the inside of the cavity to the outside of the cavity, wherein the first portion is a small loop antenna, and wherein the second portion is a short-loaded dipole antenna.

* * * * *